US010130238B2

(12) United States Patent
Durham et al.

(10) Patent No.: US 10,130,238 B2
(45) Date of Patent: Nov. 20, 2018

(54) TURBIDITY SENSOR ASSEMBLY INCLUDING AN INTEGRAL WATER LEVEL INDICATOR

(71) Applicant: Haier US Appliance Solutions, Inc., Wilmington, DE (US)

(72) Inventors: Kyle Edward Durham, Louisville, KY (US); Craig Curtis, Crestwood, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 168 days.

(21) Appl. No.: 15/203,873

(22) Filed: Jul. 7, 2016

(65) Prior Publication Data

US 2018/0008116 A1 Jan. 11, 2018

(51) Int. Cl.

| | |
|---|---|
| ***A47L 15/00*** | (2006.01) |
| ***A47L 15/50*** | (2006.01) |
| ***A47L 15/23*** | (2006.01) |
| ***A47L 15/42*** | (2006.01) |

(52) U.S. Cl.

CPC ..... *A47L 15/0031* (2013.01); *A47L 15/0044* (2013.01); *A47L 15/0047* (2013.01); *A47L 15/0052* (2013.01); *A47L 15/23* (2013.01); *A47L 15/4221* (2013.01); *A47L 15/4225* (2013.01); *A47L 15/4261* (2013.01); *A47L 15/4297* (2013.01); *A47L 15/507* (2013.01); *A47L 2401/09* (2013.01); *A47L 2401/10* (2013.01); *A47L 2501/05* (2013.01)

(58) Field of Classification Search

CPC ..... A47L 15/0031; A47L 15/4297; A47L 15/0052; A47L 15/0047; A47L 15/0044; A47L 15/4261; A47L 15/4221; A47L 15/23; A47L 15/4225; A47L 15/507; A47L 2501/05; A47L 2401/10; A47L 2401/09

See application file for complete search history.

(56) References Cited

U.S. PATENT DOCUMENTS

| | | | | |
|---|---|---|---|---|
| 5,265,446 A * | 11/1993 | Kuroda | ..... | A47L 15/4297 134/57 D |
| 6,752,875 B2 | 6/2004 | Kiesler et al. | | |
| 7,392,813 B2 * | 7/2008 | Bertram | ..... | A47L 15/4297 134/113 |
| 7,588,038 B2 | 9/2009 | Jeong | | |

(Continued)

*Primary Examiner* — Michael E Barr
*Assistant Examiner* — Benjamin L Osterhout
(74) *Attorney, Agent, or Firm* — Dority & Manning, P.A.

(57) ABSTRACT

A turbidity sensor assembly for a dishwasher appliance is provided. The turbidity sensor assembly measures the turbidity of wash fluid in a manner similar to conventional turbidity sensors, but also includes an integral water level indicator. The water level indicator is an opaque buoyant ball that rises and falls with the water level to provide a water level indication that can be used to shut off the drain pump when the sump is empty. More specifically, when the water level drops below a predetermined level, the opaque ball blocks the transmission of light between the emitter and receiver of the turbidity sensor, thus indicating that the sump is almost empty. As a result, the pump operating during a drain cycle need only operate long enough to drain the sump, and this may be achieved without an additional measuring device or complicated control system.

20 Claims, 5 Drawing Sheets

(56) References Cited

U.S. PATENT DOCUMENTS

| | | | | |
|---|---|---|---|---|
| 8,169,622 | B1 * | 5/2012 | Reith | G01N 21/534 200/511 |
| 2005/0051201 | A1 * | 3/2005 | Ashton | A47L 15/0084 134/104.1 |
| 2006/0103842 | A1 * | 5/2006 | Tokhtuev | G01N 21/53 356/338 |
| 2007/0272283 | A1 * | 11/2007 | Choi | A47L 15/4297 134/56 D |
| 2008/0030712 | A1 * | 2/2008 | Tokhtuev | G01N 21/6402 356/51 |
| 2010/0139698 | A1 * | 6/2010 | Gnadinger | A47L 15/23 134/25.2 |
| 2013/0278921 | A1 * | 10/2013 | Choi | G01N 21/85 356/51 |
| 2014/0261560 | A1 * | 9/2014 | Mealman | A47L 15/0052 134/25.2 |
| 2014/0299167 | A1 * | 10/2014 | Hong | A47L 15/4221 134/183 |
| 2015/0129004 | A1 * | 5/2015 | Lee | A47L 15/4278 134/198 |
| 2015/0182103 | A1 * | 7/2015 | Jung | A47L 15/4282 134/182 |
| 2017/0234848 | A1 * | 8/2017 | Cheng | G01N 21/17 73/61.41 |

* cited by examiner

*FIG. –5–*

TURBIDITY SENSOR ASSEMBLY INCLUDING AN INTEGRAL WATER LEVEL INDICATOR

FIELD OF THE INVENTION

The subject matter of the present disclosure relates generally to turbidity sensor assemblies that can be used in a consumer appliance such as a dishwasher, or more specifically, to turbidity sensor assemblies including integral water level indicators.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

A dishwashing appliance is typically equipped with at least one pump for circulating wash fluid through the multiple spray assemblies during a wash or rinse cycle or discharging wash fluid from the dishwasher appliance during a drain cycle. During a wash cycle, the pump circulates the wash fluid through the multiple spray assemblies to clean articles placed within the wash compartment. The soiled wash fluid falls down and collects in a sump portion of the dishwasher appliance before being recirculated by the pump. As the wash cycle progresses and the wash fluid continues to circulate, the wash fluid becomes soiled and cleaning efficiency is decreased.

Notably, certain dishwasher appliances include a turbidity sensor for measuring the soil level of wash fluid being circulated through the dishwasher appliance. When the soil level of the wash fluid (e.g., as measured by the turbidity sensor) exceeds a certain threshold, the dishwasher appliance may initiate a full or partial drain cycle. In this manner, heavily soiled wash fluid may be discharged and the dishwasher appliance may be replenished with fresh wash fluid if another wash or rinse cycle is needed.

During a drain cycle, the pump will operate to discharge wash fluid for a predetermined amount of time. Notably, the time required to drain the wash fluid from a particular dishwasher appliance varies significantly depending upon a variety of factors. For example, the height of the discharge drain in the room where the dishwasher appliance is located may vary. In addition, clogged drains, inefficient pumps, variations in water valves, or other appliance variations can cause significant variation in the amount of time required to discharge all wash fluid in the sump.

Because the drain time is often fixed by the manufacturer, the fixed drain time is often selected to ensure full draining of the sump portion in the most demanding application. Therefore, in most applications, the actual drain time can be significantly less than the drain time fixed by the manufacturer. In this regard, the pump runs longer than necessary to ensure all of the wash fluid is discharged, resulting in wasted energy and increased noise levels which are disturbing to consumers.

Some dishwasher appliances might use a dedicated water level indicator to measure the level of water remaining in the sump portion of the dishwasher appliance. However, such water level indicators can add to the overall cost of producing the appliance, require time consuming and inconvenient calibration, result in a more complicated control system, and increase the likelihood of malfunction and required repair.

Accordingly, a dishwashing appliance that can be configured to operate a drain cycle for the minimal time needed to drain wash fluid from the sump would be useful. More particularly, a turbidity sensor that incorporates a water level indicator that may be used to determine the water level during a drain cycle and eliminate the need for an additional measuring device would be especially beneficial.

BRIEF DESCRIPTION OF THE INVENTION

The present invention provides a turbidity sensor assembly for a dishwasher appliance. The turbidity sensor assembly measures the turbidity of wash fluid in a manner similar to conventional turbidity sensors, but also includes an integral water level indicator. The water level indicator is an opaque buoyant ball that rises and falls with the water level to provide a water level indication that can be used to shut off the drain pump when the sump is empty. More specifically, when the water level drops below a predetermined level, the opaque ball blocks the transmission of light between the emitter and receiver of the turbidity sensor, thus indicating that the sump is almost empty. As a result, the pump operating during a drain cycle need only operate long enough to drain the sump, and this may be achieved without an additional measuring device or complicated control system. Additional aspects and advantages of the invention will be set forth in part in the following description, may be apparent from the description, or may be learned through practice of the invention.

In one exemplary embodiment, a dishwasher appliance defining a vertical direction, a lateral direction, and a transverse direction is provided. The dishwasher appliance includes a wash chamber for receipt of articles for washing, a sump positioned adjacent a bottom of the wash chamber, the sump configured for collecting wash fluid, and a pump in fluid communication with the sump, the pump being configured for discharging the wash fluid from the dishwasher appliance during a drain cycle. The dishwasher appliance further includes a turbidity sensor assembly configured for measuring a turbidity and a level of wash fluid in the sump. The turbidity sensor assembly includes a housing defining a channel in fluid communication with the wash fluid. An emitter and a receiver are positioned within the housing on opposite sides of the channel and a buoyant object positioned within the channel. A retention device is configured to enable the buoyant object to move along with the level of the wash fluid within the channel along the vertical direction between a raised position and a lowered position.

In another exemplary embodiment, a turbidity sensor assembly for measuring a turbidity and a level of a fluid is provided. The turbidity sensor assembly includes a housing defining a vertically-oriented channel in fluid communication with the fluid. An emitter and a receiver are positioned within the housing on opposite sides of the vertically-oriented channel and a buoyant object positioned within the vertically-oriented channel. A retention device is configured to enable the buoyant object to move along with the level of the fluid within the vertically-oriented channel between a raised position and a lowered position.

In still another exemplary embodiment, a method for operating a drain cycle of a dishwasher appliance is provided. The method includes initiating a drain cycle by operating a drain pump and providing a turbidity sensor assembly for measuring a turbidity and level of a wash fluid, the turbidity sensor assembly including a housing defining a channel, the channel being configured to receive a buoyant object. The method further includes monitoring the measured turbidity of the wash fluid and initiating a drain stop cycle when the measured turbidity exceeds a predetermined threshold.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
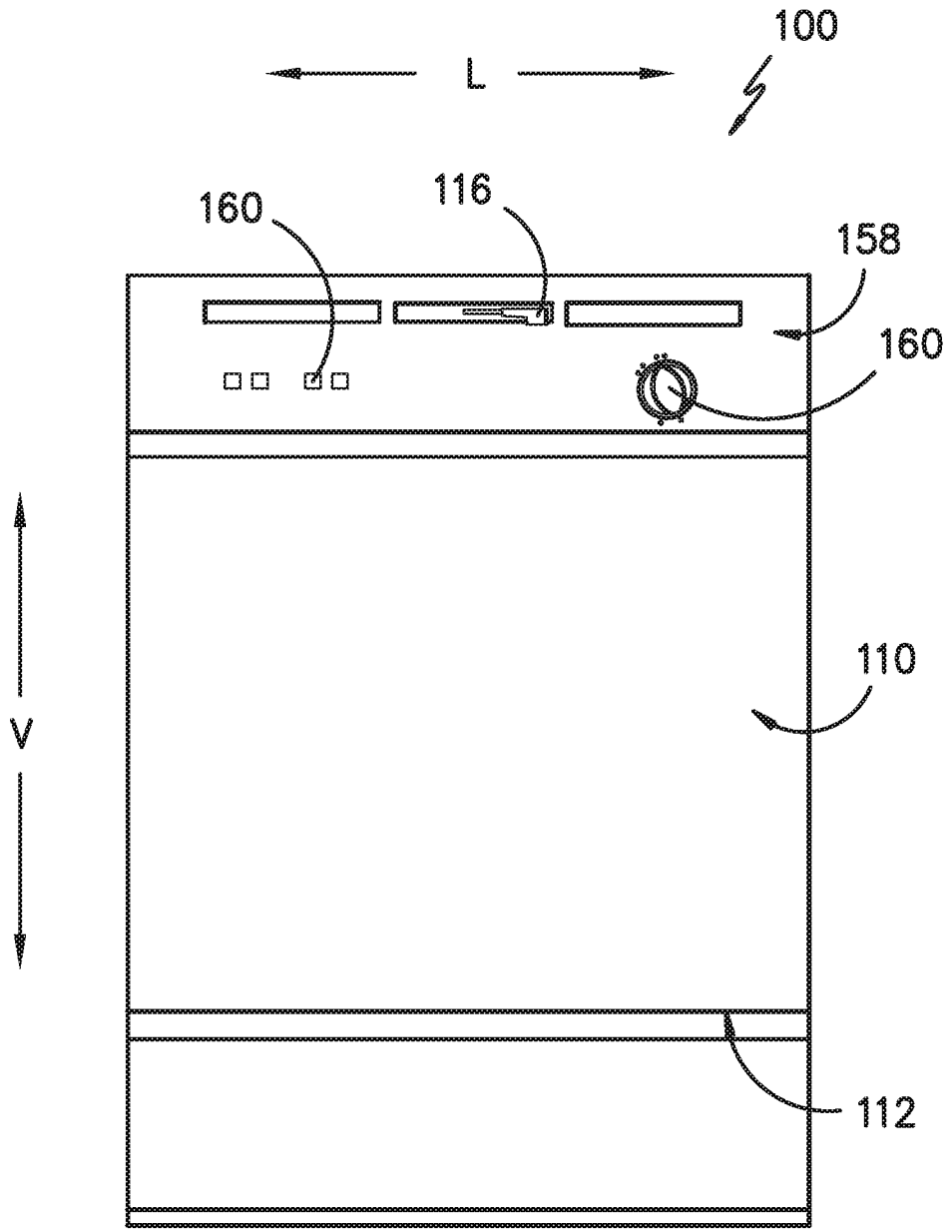
FIG. 1 provides a front view of an exemplary embodiment of a dishwashing appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "drain cycle" is intended to refer to one or more periods of time in which the dishwashing appliance operates to discharge wash fluid from the dishwashing appliance to an external drain. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as exemplary embodiments disclosed herein are not limited to the vertical orientation shown nor to any particular configuration shown; other constructions and orientations may also be used.

Figure 2:
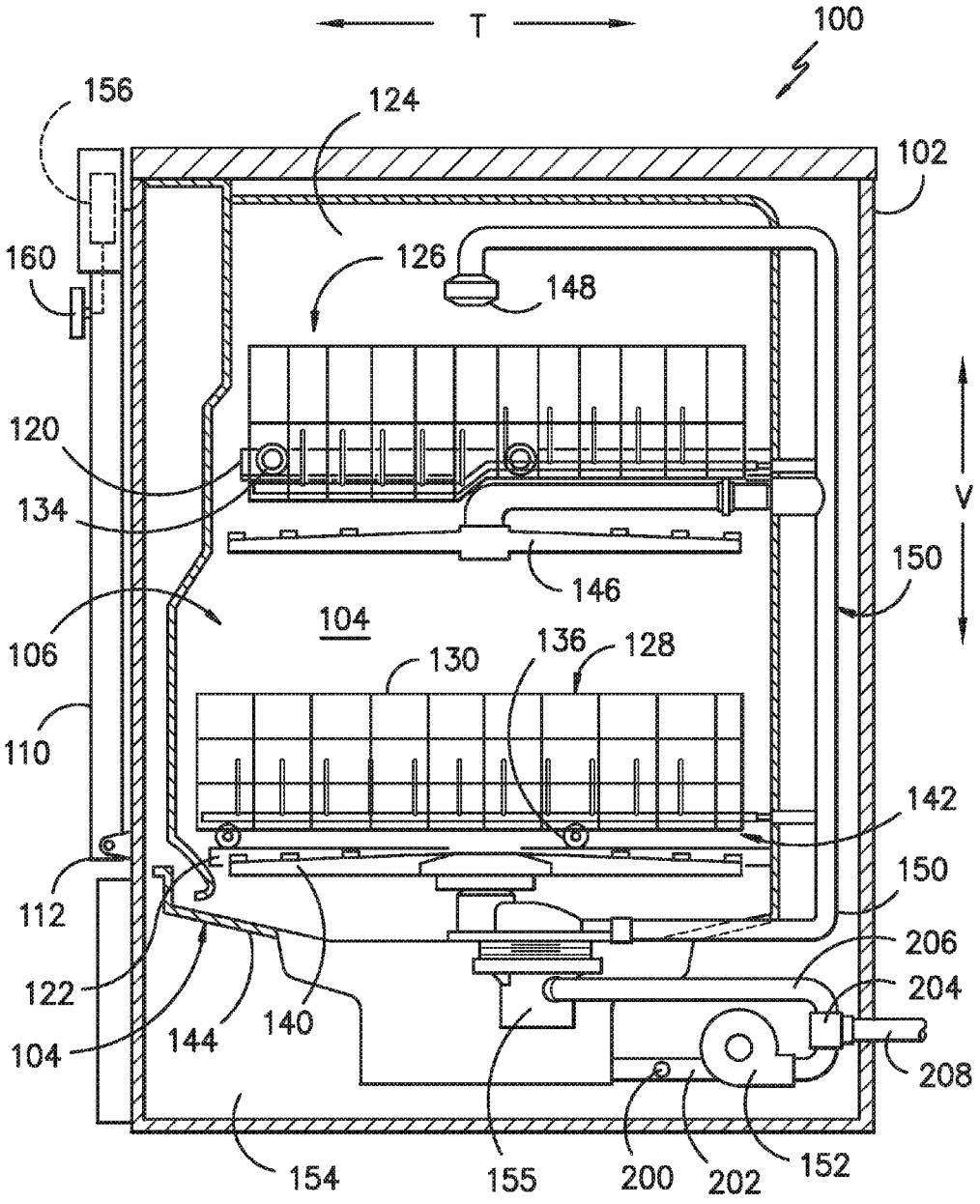
FIG. 2 provides a side cross sectional view of the exemplary dishwashing appliance of FIG. 1.

FIGS. 1 and 2 depict an exemplary domestic dishwasher 100 that may be configured in accordance with aspects of the present disclosure. For the particular embodiment of FIGS. 1 and 2, dishwasher 100 defines a vertical direction V, a lateral direction L and a transverse direction T. The vertical, lateral and transverse directions are mutually perpendicular and form an orthogonal direction system. Dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to chamber 106.

Upper and lower guide rails 120, 122 are mounted on tub side walls 124 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 140, 146 and the upper spray assembly 148 are part of a fluid circulation assembly 150 for circulating water and dishwasher fluid in the tub 104. The fluid circulation assembly 150 also includes a pump 152 positioned in a machinery compartment 154 located below or adjacent the tub sump portion 144 of the tub 104, as generally recognized in the art. Pump 152 is in fluid communication with tub sump portion 144. Therefore, wash fluid disposed in sump portion 144 may be selectively removed (i.e., recirculated or drained) from sump portion 144 by pump 152, as discussed below. Pump 152 receives fluid from sump 144 and provides a flow to a diverter 155 to perform a wash or rinse cycle. Diverter 155 is generally located between pump 152 and the conduits to the different spray arm assemblies 140, 146, 148, and is configured for selectively diverting the flow of wash fluid between spray arm assemblies 140, 146, 148.

Each spray-arm assembly 140, 146 includes an arrangement of discharge ports or orifices for directing washing liquid received from diverter 155 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 155 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

Each spray assembly may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher 100 is further equipped with a controller 156 to regulate operation of the dishwasher 100. The controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 156 may be positioned in a variety of locations throughout dishwasher 100. In the illustrated embodiment, the controller 156 may be located within a control panel area 158 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 156 includes a user interface panel/controls 160 through which a user may select various operational features and modes and monitor progress of the dishwasher 100. In one embodiment, the user interface 160 may represent a general purpose I/O ("GPIO") device or functional block. In one embodiment, the user interface 160 may include input components, such as one or more of a variety of electrical, mechanical or electro-mechanical input devices including rotary dials, push buttons, and touch pads. The user interface 160 may include a display component, such as a digital or analog display device designed to provide operational feedback to a user. The user interface 160 may be in communication with the controller 156 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 160, different configurations may be provided for racks 126, 128, different spray arm assemblies 140, 146, 148 may be used, and other differences may be applied as well.

Figure 3:
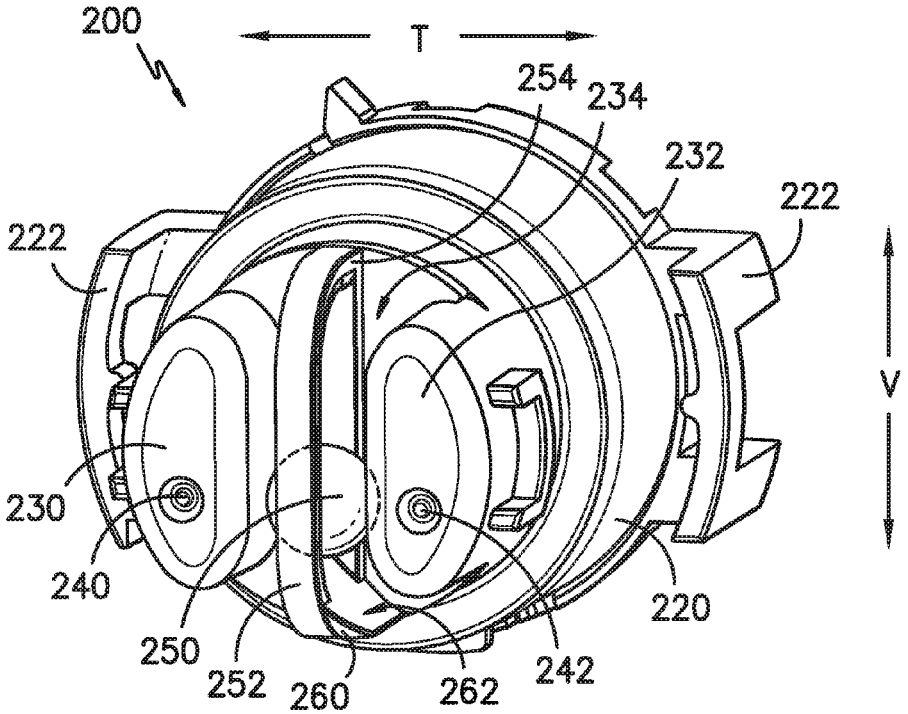
FIG. 3 is a perspective view of an exemplary turbidity sensor assembly that may be used with the exemplary dishwashing appliance of FIG. 1 according to an exemplary embodiment of the present subject matter, with an indicator ball shown in the lowered position.
Figure 4:
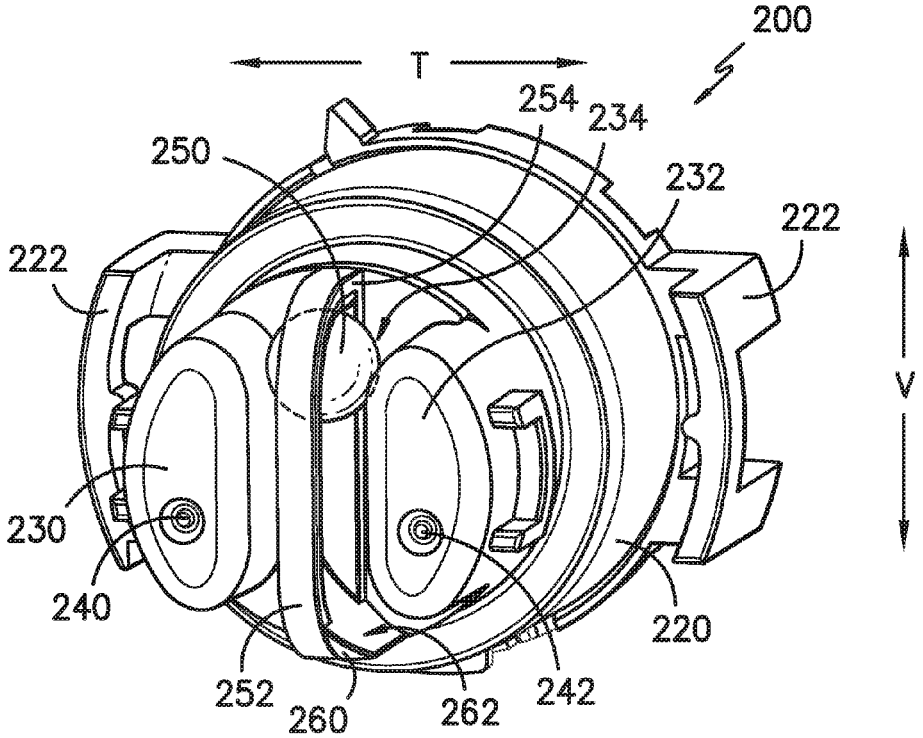
FIG. 4 is a perspective view of the exemplary turbidity sensor assembly of FIG. 3, with the indicator ball shown in the raised position.

Referring now to FIGS. 3 and 4, a turbidity sensor assembly 200 according to an exemplary embodiment of the present subject matter will be described. As illustrated, turbidity sensor assembly 200 is positioned within an inlet pipe 202 to pump 152. In this regard, turbidity sensor assembly 200 is in fluid communication with sump 144, and may be used to measure the turbidity of wash fluid contained therein. As discussed herein, turbidity sensor may refer any sensor that senses a level of soil or sediment within a wash fluid. In this regard, turbidity sensors typically operate on the principle that when light is passed through a fluid, the amount of light transmitted through the fluid is dependent on the amount of soil in the fluid. As the soil level increases, the amount of transmitted light decreases. A turbidity sensor measures the amount of transmitted light to determine the turbidity of the fluid.

For example, turbidity sensor assembly 200 may output a signal (e.g., a voltage or current) to controller 156 corresponding to a turbidity of wash fluid measured by turbidity sensor assembly 200. Turbidity is often measured in nephelometric turbidity units (NTU), with a higher NTU indicating more heavily soiled water. Turbidity sensor assembly 200 can also be used to provide an output signal indicative of when sump 144 is empty, as discussed below. In this manner, turbidity sensor assembly 200 can be used to sense a level of sediment in the sump 144 and to initiate a full or partial drain cycle where the contents or a fractional volume of the contents of the sump 144 are discharged when a turbidity level in the sump 144 approaches a predetermined threshold.

Referring again briefly to FIG. 2, pump 152 is configured to operate in both a wash/rinse cycle and a drain cycle. In this regard, a three way valve 204 is positioned downstream of pump 152 and is configured to direct wash fluid pumped by pump 152 to either a recirculation conduit 206 (i.e., during the wash/rinse cycle) or a discharge conduit 208 (i.e., during the drain cycle). More specifically, when three way valve 204 is configured for the wash/rinse cycle, pump 152 is in fluid communication with recirculation conduit 206 and diverter 155, which may operate to selectively distribute wash fluid to spray arm assemblies 140, 146, 148. By contrast, when three way valve 204 is configured for the drain cycle, pump 152 is in fluid communication with discharge conduit 208, which is used to discharge used wash fluid to an external drain.

It should be appreciated that according to alternative embodiments, different plumbing configurations may be used to drive wash fluid for the various operating cycles. For example, dishwasher appliance 100 may include a dedicated drain pump and valve system in addition to a wash/rinse pump. In such an embodiment, turbidity sensor assembly 200 may be positioned either upstream of the wash/rinse pump or the drain pump. As illustrated in FIG. 2, turbidity sensor assembly 200 is located on inlet pipe 202 to pump 152. However, it should be appreciated that turbidity sensor assembly 200 could also be located other places in sump 144 of dishwasher appliance, or any other suitable location where it is exposed to wash fluid. In addition the wash/rinse pump and drain pump may be coupled to a shared conduit in fluid communication with sump 144 of dishwasher appliance 100 or may each be connected directly to the side or the bottom of sump 144. Although one embodiment of a fluid circulation assembly is described herein, it is contemplated that other fluid circulation assembly configurations may similarly be utilized without departing from the spirit and scope of the present subject matter.

Referring again to FIGS. 3 and 4, turbidity sensor assembly 200 generally includes a housing 220 that contains many of the working components of turbidity sensor assembly 200. Notably, when turbidity sensor assembly 200 is installed on inlet pipe 202, at least a portion of housing 220 is disposed within inlet pipe 202. However, a portion of housing 220 may also be positioned outside inlet pipe 202 and may be configured to receive electrical wires. In this regard, inlet pipe 202 may define a boss with a mounting flange (not shown) that is configured to removably receive turbidity sensor assembly 200. For example, turbidity sensor assembly 200 may include a plurality of mounting features 222 that may be secured to the boss on inlet pipe 202 to secure and seal turbidity sensor assembly 200 to inlet pipe 202. Housing 220 may be secured and sealed to inlet pipe 202 using any suitable means, such as a threaded connection, a snap-fit connection, mechanical clips, mechanical fasteners, etc. Other configurations are also possible.

Housing 220 may define a first chamber 230 and a second chamber 232 that protrude away from the remainder of housing 220. First chamber 230 and second chamber 232 are separated from each other by a channel 234. Notably, when turbidity sensor assembly 200 is installed on inlet pipe 202, first chamber 230 and second chamber 232 may extend toward a center of inlet pipe 202 and channel 230 is vertically oriented.

Turbidity sensor assembly 200 further includes an emitter 240 and a receiver 242 positioned within first chamber 230 and second chamber 232, respectively, such that channel 234 is disposed between emitter 240 and receiver 242. In this manner, wash fluid may be present between emitter 240 and receiver 242. Light may be transmitted from emitter 240 through the wash fluid to receiver 242 to measure the turbidity of wash fluid as described above. A voltage or other signal corresponding to the measured turbidity may be communicated to controller 156, e.g., via electrical connections (not shown). Electrical connections may be two wires, coaxial, or other multi connection wiring, etc., as a voltage is provided to emitter 240 and a voltage is received and transmitted by receiver 242.

Emitter 240 may be any suitable light source, such as an LED or an infrared LED. Receiver 242 may be any suitable light measuring device or sensor, such as a photovoltaic cell, e.g., a photoresistor, phototransistor, or the like. If desired, emitter 240 may be an EL-23G photodiode from Kodenshi Corp., and receiver 242 may be an ST-23G photo transistor from Kodenshi Corp. The output of receiver 242 may be a value in voltage or other measurement. Emitter 240 and receiver 242 should be spaced apart sufficiently that a reliable measurement may be obtained even when the wash fluid is quite turbid in normal operating conditions for the dishwashing appliance 100. If emitter 240 is infrared, housing 220 material can be a semi-transparent plastic such as polypropylene (PPN 4160). If other frequencies are used needing more transmission than housing 220 allows, a more transmissive material could be used, and/or optional transmissive windows could be added.

Still referring to FIGS. 3 and 4, according to an exemplary embodiment of the present subject matter, a buoyant object is positioned within channel 234 and a retention device is configured to restrain the buoyant object within channel 234. For example, according to the illustrated embodiment, the buoyant object is a spherical ball 250 and the retention device is a rod 252 positioned so as to keep spherical ball 250 within channel 234. However, according to alternative embodiments, the buoyant object may be any suitable object that fits within channel 234 and floats in the wash fluid.

The buoyant object, e.g., spherical ball 250 is constructed from or is coated with an opaque material, such that it does not transmit light emitted from emitter 240. Notably, emitter 240 and receiver 242 are positioned toward a bottom portion of first chamber 230 and second chamber 232, respectively. In this manner, when spherical ball is in the raised position (FIG. 4), turbidity sensor assembly 200 may operate normally by measuring the turbidity of wash fluid present within channel 234. By contrast, when spherical ball is in the lowered position (FIG. 3), the spherical ball is positioned between emitter 240 and receiver 242 such that it blocks all or a substantial portion of the light emitted by emitter 240. As a result, the voltage output from receiver 242 spikes and may be detected by controller as an indication that sump 144 is almost empty.

The retention device may be any suitable mechanical structure configured for keeping the buoyant object within channel 234 while allowing it to move along the vertical direction V. For example, according to an illustrated embodiment, rod 252 may generally be positioned between first chamber 230 and second chamber 232 along the transverse direction T and extend along the vertical direction V, i.e., parallel to channel 234 but outside channel 234. As illustrated, rod 252 is mounted to housing 220 at a base of channel 234 by spacing legs 254, such that rod 252 and legs 254 generally form a U-shape. Legs 254 space rod 252 away from a bottom of channel 234 by a distance equal to or slightly larger than a diameter of spherical ball 250. In this manner, spherical ball 250 is free to move along with the level of the wash fluid within channel 234 along the vertical direction V between a lowered position (FIG. 3) and a raised position (FIG. 4).

Rod 252 (and legs 254) may be attached to housing 220 of turbidity sensor assembly 200 or may be integrally formed with housing 220. According to an exemplary embodiment, rod 252 is constructed from the same material as housing 220 and is molded as a single integral piece. Housing 220, rod 252, and/or legs 254 may be constructed from a resilient material, such that rod 252 is deflected as spherical ball 250 is pressed into channel 234. After spherical ball 250 pops into channel 234, rod 252 may snap back into its original position where it may properly retain spherical ball 250. According to an alternative embodiment, housing 220, rod 252, and/or legs 254 may be constructed from a rigid material, and spherical ball 250 may be inserted into channel 234 prior to attaching rod 252 and/or legs 254. Other configurations of the retention device are possible and within the scope of the present subject matter.

According to an exemplary embodiment of the present subject matter, turbidity sensor assembly 200 may further include a flow redirector 260 configured for scooping a portion of the flow of the wash fluid and directing it upwards along the vertical direction V onto spherical ball 250. More specifically, flow redirector 260 is pointed upstream of the flow of the wash fluid (e.g., towards sump 144 in FIG. 2) and may extend slightly below second chamber 232 along the vertical direction V. Flow redirector 260 includes an arcuate surface 262 that redirects water flowing substantially in the horizontal direction (i.e., along the transverse direction T as illustrated in FIGS. 3 and 4) upward along the vertical direction V. In this manner, the upward flow of water urges spherical ball 250 toward the raised position (FIG. 4), such that it does not block the light between emitter 240 and receiver 242. This may be desirable in low flow situations (like a light rinse cycle) where the total volume of wash fluid is low.

Now that the construction and configuration of dishwashing appliance 100 and turbidity sensor assembly 200 according to an exemplary embodiment of the present subject matter have been presented, an exemplary method 300 of operating dishwasher appliance 100 during a drain cycle will be described. The method described below refers to operating dishwasher appliance 100, but it should be appreciated that aspects of the exemplary method 300 may be used to perform different operating cycles or other appliances as well.

Figure 5:
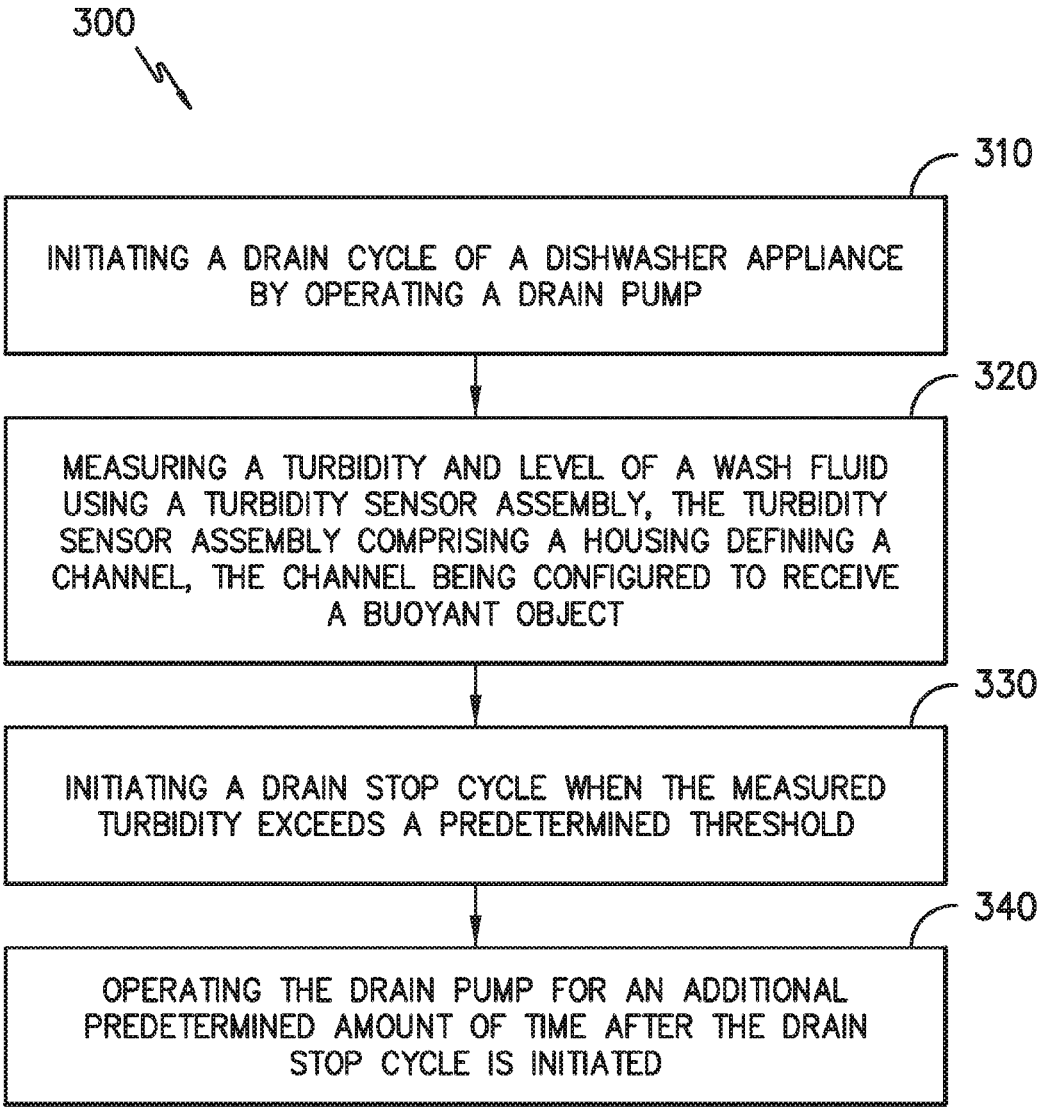
FIG. 5 provides a method for operating a drain cycle of a dishwasher appliance according to an exemplary embodiment of the present subject matter.

As illustrated in FIG. 5, method 300 includes, at step 310, initiating a drain cycle by operating a drain pump. The drain pump, which may be pump 152, is configured for discharging wash fluid within sump 144 out of dishwasher appliance 100, e.g., via discharge conduit 208. Step 320 includes measuring a turbidity and level of a wash fluid using a turbidity sensor assembly throughout an operating cycle of the dishwasher appliance 100. The turbidity sensor assembly may be, for example, turbidity sensor assembly 200, and may include housing 220 defining channel 234 configured to receive spherical ball 250. Method 300 also includes, at step 330, initiating a drain stop cycle when the measured turbidity exceeds a predetermined threshold. The predetermined threshold could be selected such that it exceeds a normal value for the actual turbidity of wash fluid, such that it can be easily detectable by controller 156 as an indication that spherical ball 250 reaches the lowered position. For example, according to one embodiment, the predetermined threshold is 2000 nephelometric turbidity units (NTUs). Notably, due to the geometric configuration of turbidity sensor assembly 200 and the position of emitter 240 and receiver 242, a small amount of wash fluid may remain in sump 144 after spherical ball reaches the lowered positioned. Therefore, at step 340, after the drain stop cycle has been initiated, the dishwasher appliance 100 may operate the drain cycle (i.e., run the drain pump) for an additional predetermined amount of time, e.g., two seconds to ensure all wash fluid has been discharged.

Figure 6:
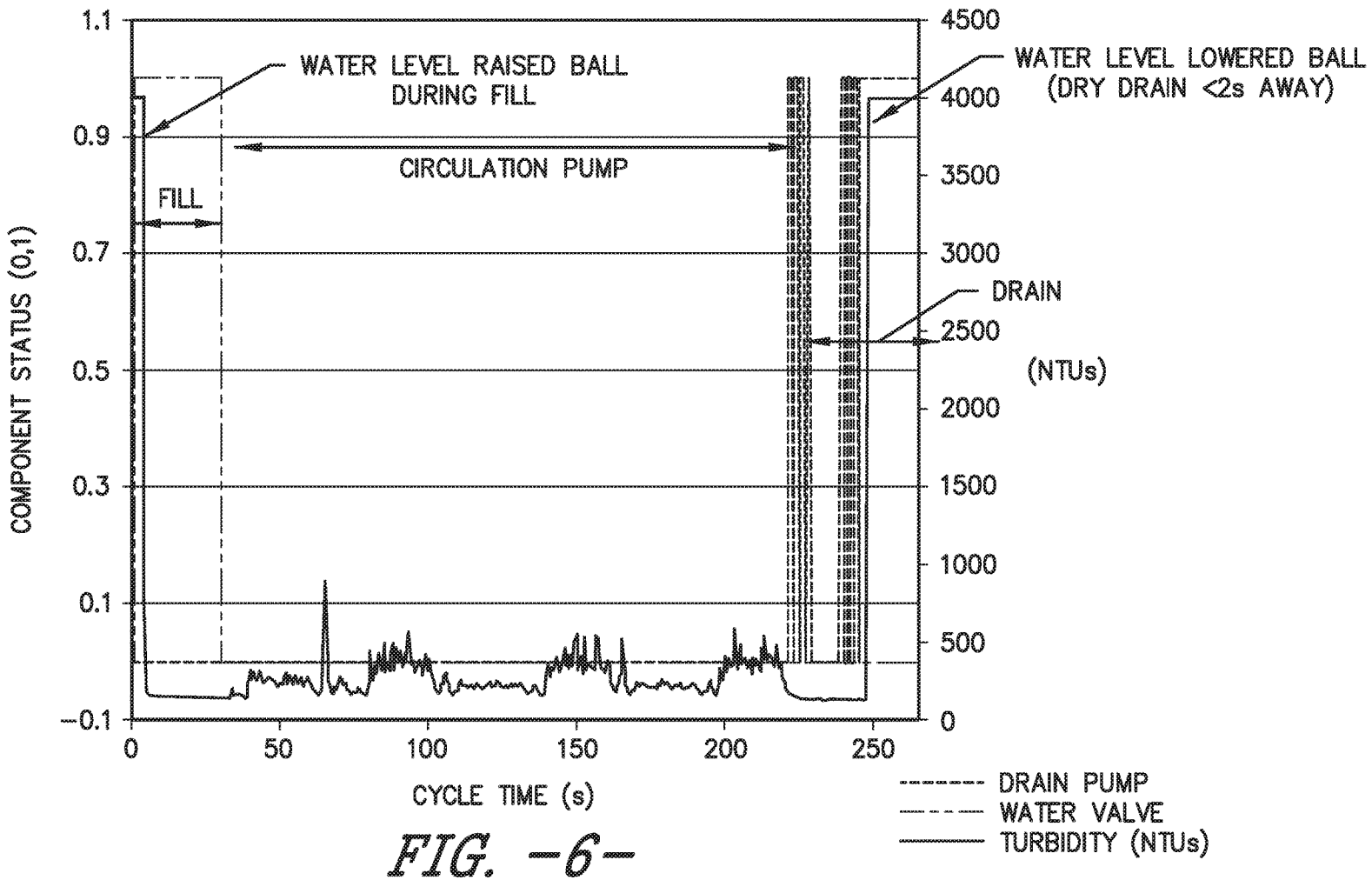
FIG. 6 is a plot illustrating the operation of the turbidity sensor assembly during a drain cycle of the exemplary dishwashing appliance of FIG. 1.

Referring now to FIG. 6, a plot illustrating the operation of a dishwasher appliance having a turbidity sensor assembly similar to turbidity sensor assembly 200 will be described. The plot illustrates the fill, circulation, and drain portion of a given dishwasher cycle. As shown, from t=0 to t=30, a water valve is opened to fill the sump portion of the dishwasher. At t=30, the water valve is closed and the pump is operated in a circulation mode, e.g., by directing water to multiple spray assemblies to wash or rinse articles in the wash chamber. During this wash/rinse cycle, the turbidity of the water fluctuates between about 100 and 500 NTUs. The drain cycle is started around t=225 and water is discharged from the sump out of the dishwasher. Notably, at t=250, the turbidity measurement spikes to approximately 4000 NTUs. The dishwasher is programmed to recognize that this spike is not actually a turbidity measurement of the wash fluid, but is instead the time at which the spherical ball or other buoyant object has blocked the light being emitted from the emitter. In this manner, the controller determines that the wash fluid in the sump is almost entirely drained. To ensure complete drainage, the drain pump may operate a predetermined amount of additional time, e.g., two seconds. In this manner, the sump may be completely drained without requiring that the pump run for an excessive amount of time, thereby conserving energy and reducing noise.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance defining a vertical direction, a lateral direction, and a transverse direction, the dishwasher appliance comprising:
- a wash chamber for receipt of articles for washing;
- a sump positioned adjacent a bottom of the wash chamber, the sump configured for collecting wash fluid;
- a pump in fluid communication with the sump, the pump being configured for discharging the wash fluid from the dishwasher appliance during a drain cycle; and
- a turbidity sensor assembly configured for measuring a turbidity and a level of wash fluid in the sump, the turbidity sensor assembly comprising:
  - a housing defining a vertically-aligned channel in fluid communication with the wash fluid;
  - an emitter and a receiver positioned within the housing on opposite sides of the vertically-aligned channel;
  - a buoyant object positioned within the vertically-aligned channel; and
  - a retention device configured to guide the buoyant object to move between a raised position and a lowered position along with the level of the wash fluid within the vertically-aligned channel.

2. The dishwasher appliance of claim 1, wherein the retention device comprises a vertically aligned rod, forms a U-shape around the vertically-aligned channel, and is attached to the housing of the turbidity sensor assembly.

3. The dishwasher appliance of claim 1, wherein the retention device is integrally formed with the housing of the turbidity sensor assembly.

4. The dishwasher appliance of claim 1, wherein the buoyant object is a spherical ball.

5. The dishwasher appliance of claim 1, wherein the buoyant object is constructed from or is coated with an opaque material.

6. The dishwasher appliance of claim 1, wherein the turbidity sensor assembly further comprises a flow redirector pointed upstream of a flow of the wash fluid, the flow redirector being configured to scoop up a portion of the flow of the wash fluid passing along a horizontal direction and direct it upwards along the vertical direction on the buoyant object.

7. The dishwasher appliance of claim 1, wherein the emitter of the turbidity sensor assembly is one or more light emitting diodes and the receiver is a light sensor.

8. The dishwasher appliance of claim 1, wherein the pump drains the wash fluid from the sump during the drain cycle, the pump being configured to stop draining when the measured turbidity exceeds a predetermined threshold.

9. The dishwasher appliance of claim 8, wherein the predetermined threshold is 2000 nephelometric turbidity units (NTUs).

10. The dishwasher appliance of claim 1, wherein the turbidity sensor assembly is positioned in a pump inlet pipe upstream of the pump.

11. The dishwasher appliance of claim 1, wherein the channel extends along the vertical direction.

12. A turbidity sensor assembly for measuring a turbidity and a level of a fluid, the turbidity sensor assembly comprising:

a housing defining a vertically-aligned channel in fluid communication with the fluid;

an emitter and a receiver positioned within the housing on opposite sides of the vertically-aligned channel;

a buoyant object positioned within the vertically-aligned channel; and a retention device configured to guide the buoyant object to move between a raised position and a lowered position along with the level of the fluid within the vertically-aligned channel.

13. The turbidity sensor assembly of claim 12, wherein the retention device comprises a vertically aligned rod, forms a U-shape around the vertically-aligned channel, and is attached to the housing of the turbidity sensor assembly.

14. The turbidity sensor assembly of claim 12, wherein the buoyant object is a spherical ball constructed from or coated with an opaque material.

15. The turbidity sensor assembly of claim 12, wherein the turbidity sensor assembly further comprises a flow redirector pointed upstream of a flow of the fluid, the flow redirector being configured to scoop up a portion of the flow of the wash fluid passing along a horizontal direction and direct it upwards along a vertical direction on the buoyant object.

16. The turbidity sensor assembly of claim 12, wherein a pump is configured for pumping the fluid until the measured turbidity exceeds a predetermined threshold.

17. The turbidity sensor assembly of claim 16, wherein the predetermined threshold is 2000 nephelometric turbidity units (NTUs).

18. A method for operating a drain cycle of a dishwasher appliance, the method comprising:

initiating a drain cycle by operating a drain pump;

measuring a turbidity and level of a wash fluid using a turbidity sensor assembly, the turbidity sensor assembly comprising a housing defining a channel, the channel being configured to receive a buoyant object;

monitoring the measured turbidity of the wash fluid; and initiating a drain stop cycle when the measured turbidity exceeds a predetermined threshold:

wherein the turbidity sensor assembly comprises:

the housing defining the channel, wherein the channel is vertically-aligned, in fluid communication with the fluid;

an emitter and a receive positioned with the housing on opposite sides of the vertically-aligned channel;

a buoyant object positioned within the vertically-aligned channel; and a retention device configured to guide the buoyant object to move between a raised position and a lowered position along with the level of the fluid within the vertically-aligned channel.

19. The method of claim 18, wherein the predetermined threshold is 2000 nephelometric turbidity units (NTUs).

20. The method of claim 18, wherein initiating the drain stop cycle comprises operating the drain pump for an additional predetermined amount of time.

* * * * *